US006101851A

United States Patent [19]

Bolduan et al.

[11] Patent Number: 6,101,851

[45] Date of Patent: Aug. 15, 2000

[54] HOUSEHOLD WASHING MACHINE WITH LINES FOR CONDUCTING WATER AND AIR

[75] Inventors: Edwin Bolduan; Horst Wiemer, both of Berlin, Germany

[73] Assignee: BSH Bosch und Siemens Hausgeraete GmbH, Munich, Germany

[21] Appl. No.: 08/931,373

[22] Filed: Sep. 16, 1997

[30] Foreign Application Priority Data

Sep. 16, 1996 [DE] Germany ..... 196 37 742

[51] Int. Cl.[7] ..... D06F 39/08

[52] U.S. Cl. ..... 68/17 R; 68/207; 68/208

[58] Field of Search ..... 68/17 R, 207, 68/208

[56] References Cited

U.S. PATENT DOCUMENTS

| | | | |
|---|---|---|---|
| 3,019,629 | 2/1962 | Ross | 68/17 R |
| 3,339,587 | 9/1967 | Dicken, Jr. | 68/207 X |
| 3,367,153 | 2/1968 | Brubaker et al. | 68/207 X |
| 3,381,700 | 5/1968 | Frymark | 68/207 X |
| 3,508,571 | 4/1970 | Dutcher et al. | 68/207 X |

FOREIGN PATENT DOCUMENTS

| | | | |
|---|---|---|---|
| 248902 | 5/1963 | Australia | 68/207 |
| 1234442 | 6/1971 | United Kingdom | 68/207 |

*Primary Examiner*—Philip R. Coe
*Attorney, Agent, or Firm*—Herbert L. Lerner; Laurence A. Greenberg; Werner H. Stemer

[57] ABSTRACT

A household washing machine includes a common plastic line-routing body in which all water-conducting and air-conducting lines that are routed on a rear wall of the washing machine are integrated. Supply line openings of the line-routing body are sealingly connected through elastic sealing sleeves to inlet locations and outlet locations, such as solenoid valves and a detergent dispenser, and mechanically retained.

12 Claims, 2 Drawing Sheets

HOUSEHOLD WASHING MACHINE WITH LINES FOR CONDUCTING WATER AND AIR

BACKGROUND OF THE INVENTION

Field of the Invention

The invention relates to a household washing machine with lines for the distributed supply of clean water, for discharging used detergent solution and for conducting pressure-compensating air.

Such washing machines are known from German Published, Non-Prosecuted Patent Application DE 37 34 117 A1, they are in common use and for the lines they invariably use more or less flexible tubes or hose sections for respectively connecting stubs of water-handling or air-handling devices disposed at different locations in the washing machine. For example, use is invariably made of flexible hose lines between the stubs of electrically connected solenoid valves and the inlet stubs of a detergent dispenser. Use is also made of a likewise flexible hose line from the pressure-compensating stub of an overflow bend on the detergent-solution discharge line to a corresponding stub, for example on the detergent dispenser, for the purpose of compensating for pressure differences. Furthermore, individual riser pipes made of flexible hoses are routed between a detergent-solution pump and an overflow bend, usually produced from plastic, and, if one is present, a down pipe in the form of a flexible hose line is routed from the discharge stub of a detergent-dispenser tray to the housing of the detergent-solution pump.

In addition to the comparatively expensive production of special line parts in each case for supplying clean water, pressure compensation and discharging detergent solution, the storage and any logistics required for those parts are also time-consuming and cost-intensive. It is also time-consuming and cost-intensive to fit all of those individual parts during the production process of a washing machine.

SUMMARY OF THE INVENTION

It is accordingly an object of the invention to provide a household washing machine with lines for conducting water and air, which overcomes the hereinafore-mentioned disadvantages of the heretofore-known devices of this general type and which provides the most cost-effective system possible for conducting water within the washing machine. It should be ensured in this case that the number of individual parts required for the system is as small as possible and that these parts can be produced as easily as possible.

With the foregoing and other objects in view there is provided, in accordance with the invention, a household washing machine, comprising lines for a distributed supply of clean water, for discharging used detergent solution and for conducting pressure-compensating air; inlet and outlet locations for the lines; a common plastic line-routing body for routing the lines from the inlet locations to the outlet locations, the line-routing body having supply line openings; and elastic sealing sleeves mechanically retaining and sealingly connecting the supply line openings to the inlet and outlet locations.

The inventive configuration of a household washing machine of the type mentioned in the introduction makes it possible for the number of components to be reduced considerably. Furthermore, various retaining elements are dispensed with due to the rigid construction of the plastic line-routing body, which is fitted between all of the line openings through sealing sleeves, with water-handling assemblies disposed fixedly within the housing of the washing machine.

This simultaneously renders fitting easier because all of the line parts are combined within the one plastic line-routing body, and there is thus no need to fit individual hose parts with two hose clips in each case. Moreover, as far as sealing is concerned, there is an improvement in quality because it is no longer necessary to ensure an optimum fit of clips on the hose connections. In contrast, due to the fixed dimensions between the assemblies which are to be connected, the fitting of the compact line-routing body has to have an automatic sealing action. Finally, the plastic line-routing body makes it possible to use a single assembly formed of recyclable polypropylene as a replacement for a large number of individual components formed of different materials.

In accordance with another feature of the invention, on the inlet side, the lines for supplying clean water are connected directly to the outlets of solenoid valves. In accordance with a further feature of the invention, the lines for supplying clean water are connected directly, on the outlet side, to the inlets of a detergent-dispenser tray. This makes it possible to avoid at least two or three individual hose lines, together with their hose clips which are required for sealing, between the solenoid valves and the detergent dispenser.

In accordance with an added feature of the invention, the line-routing body also contains a line for conducting overflow water. Overflow water may be channeled, for example, through the detergent dispenser and, from there, through a directed outlet line to a collecting tray, in which level-sensor switching devices are disposed in order to prevent overflow.

In accordance with an additional feature of the invention, there is provided a direct connection of the inlet side of the line for conducting overflow water to an overflow stub of the detergent dispenser.

In accordance with yet another feature of the invention, a pressure-compensating line for conducting pressure-compensating air is integrate in the line-routing body, on the inlet side it is connected directly to an air-extraction stub of the detergent dispenser and on the outlet side it is connected to an overflow bend.

In accordance with yet a further feature of the invention, the line-routing body contains a riser pipe and a down pipe for discharging the used-up detergent solution, and an overflow bend which connects these two pipes.

In accordance with yet an added feature of the invention, the overflow bend is connected to a backflow tank which is located in the path of the riser pipe and is intended for retaining a quantity of detergent solution which is required for backwashing.

In the case of the integral configuration of the line-routing body, the integration of the detergent-solution-discharging device in the line-routing body provides the greatest advantage in comparison with the production, the logistics and the fitting of individual line parts and hoses with their connecting elements.

In accordance with yet an additional feature of the invention, in production terms, the line-routing body is configured in a simple manner by being formed from a plastic blow molding.

In accordance with a concomitant feature of the invention, in order to provide for the fitting of such a line-routing body, at least one strap is integrally formed on the line-routing body for the purpose of temporarily retaining the line-routing body before the line connections are fitted. For the purpose of temporarily retaining the line-routing body, such straps can be hung over edges or fitted in slits provided for this purpose in housing parts for washing machines.

Other features which are considered as characteristic for the invention are set forth in the appended claims.

Although the invention is illustrated and described herein as embodied in a household washing machine with lines for conducting water and air, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DESCRIPTION OF THE PREFERRED EMBODIMENTS

Figure 1:
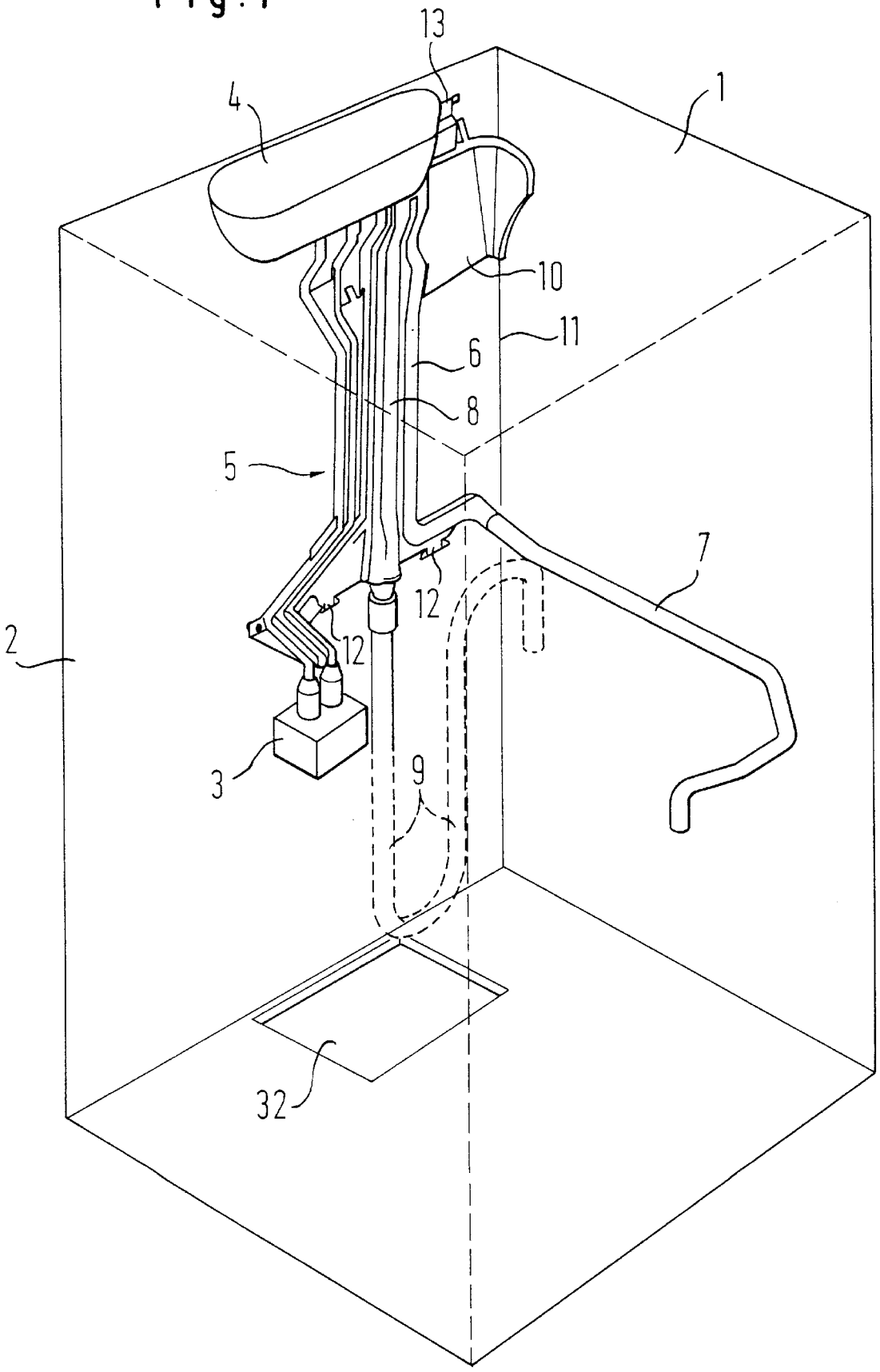
FIG. 1 is a diagrammatic, perspective view of a washing machine, from which those parts that do not form part of the invention have been fully removed.

Referring now to the figures of the drawings in detail and first, particularly, to FIG. 1 thereof, there is seen a washing-machine housing 1 in which a solenoid-valve block 3 with two outlets as well as a detergent dispenser 4 are provided, for example on a rear wall 2. A non-illustrated rear underside of the detergent dispenser 4 has two inlet stubs for supplying clean water and an overflow stub for discharging water from a non-illustrated tub through a likewise non-illustrated detergent-supply line and the detergent dispenser 4. The detergent dispenser 4 also has an air-admission stub, which is connected to the atmosphere. This air-admission stub invariably serves for conducting air from the atmosphere into an overflow bend of a detergent-solution-discharging system. This ensures that, when delivery of a detergent-solution pump is interrupted, a water column in a riser pipe of the detergent-solution-discharging system is discontinued and does not siphon off the contents of the tub.

A line-routing body 5 is provided between the water-handling assemblies for all of these conducting tasks. A water-conducting line 7 (single component) which is connected to a riser pipe 6 of the body 5 can channel detergent solution that is to be pumped away from a non-illustrated detergent-solution pump. It would be technically possible to integrate the line 7 in the line-routing body 5. However, for reasons of handling during a fitting operation, such an integration is not recommended because the detergent-solution pump should be disposed at a point remote from the rear wall, that is to say as close as possible to a front wall of the washing machine. This would mean that the line-routing body 5 would extend too far and, for this reason, would pose handling difficulties in terms of logistics and fitting. A hose line 9 is connected to an outlet stub of a down pipe 8 of the line-routing body 5. The hose line 9 is routed out of the machine housing 1 at a location which is not illustrated specifically herein and therefore it is illustrated by dashed lines over part of its length. A backflow tank 10 is connected in a flow path of an overflow bend shown in FIG. 2 and is of extremely flat configuration. The backflow tank 10 is routed around a corner in front of a rear housing edge 11, on one hand to provide as much room as possible for its contents, while on the other hand to occupy as little as possible of a vibrating area which is required by a vibrating tub unit.

In order to temporarily fix the line-routing body 5 before the line connections are produced, the line-routing body 5 is provided with straps 12 and 13 which can be inserted through slits in the rear wall of the housing for retaining the line-routing body 5 in such a way that it can move in the longitudinal direction of the lines.

Figure 2:
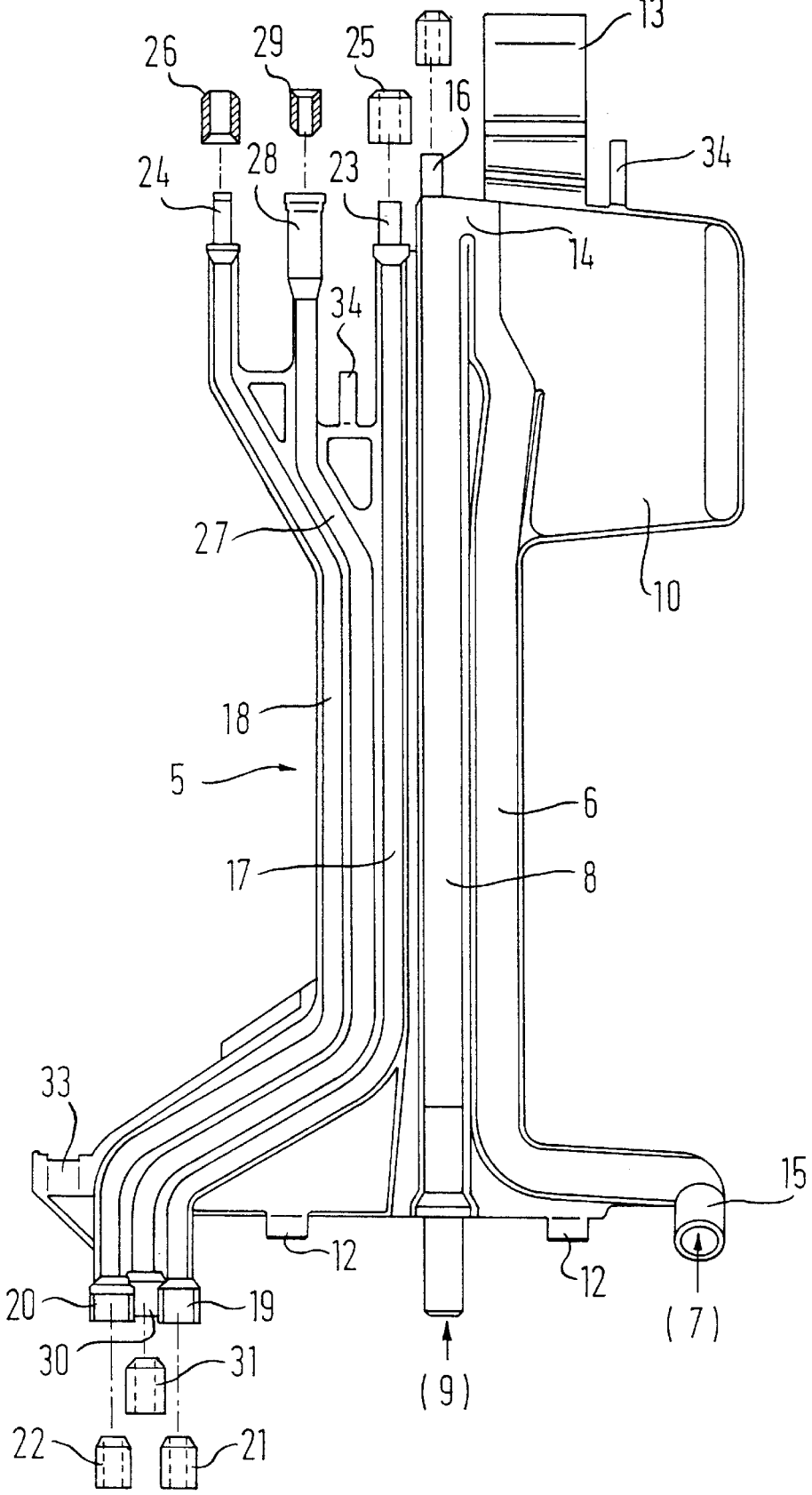
FIG. 2 is a front-elevational view of a line-routing body which is configured according to the invention and has sealing sleeves provided for medium flow connection.

The line-routing body 5, which is illustrated specifically in FIG. 2, contains the already-mentioned riser pipe 6 and down pipe 8 as well as the backflow container 10 disposed in the path of the overflow bend 14. A detergent solution from the connecting tube 7, which solution is to be pumped away, fills the backflow container 10 through a stub 15 and the riser pipe 6, before it passes through the overflow bend 14 and the down pipe 8 to the discharge hose 9. As soon as a pump pressure in the riser pipe 6 decreases, atmospheric air flows out of the stub 16 into the overflow bend 14 and allows detergent-solution columns to be discontinued. This avoids a situation in which, after the overflow bend 14 has been reached, it is also possible for the tub to be emptied automatically by suction action when the pump is switched off.

The line routing body 5 further contains clean-water-supply lines 17 and 18 which are connected through inlet-side stubs 19 and 20 and elastic sealing sleeves 21 and 22 to non-illustrated outlet stubs of the solenoid valves 3 shown in FIG. 1. In the same way, outlet stubs 23 and 24 of the lines 17 and 18 are connected through sealing sleeves 25 and 26 to non-illustrated inlet stubs of the detergent dispenser 4. A line 27 for conducting overflow water is disposed in the line-routing body 5 between the supply lines 17 and 18. A likewise non-illustrated overflow stub in the detergent dispenser 4 is connected through a sealing sleeve 29 to an inlet stub 28 of the line 27. An outlet-side stub 30 of the line 27 can open into a water-conducting device either freely or through a sealing sleeve 31. The water-conducting device conducts the discharged overflow water into a base tray 32 shown in FIG. 1, where non-illustrated safety switching devices may signal the presence of overflow water. The block 3 and the detergent dispenser 4 may be considered inlet and outlet locations for the lines 6, 8, 10, 17, 18, 27.

As has already been described in relation to FIG. 1, the straps 12 and 13 are inserted into appropriate slits for the purpose of temporarily fitting the line-routing body on the rear wall of the washing machine. Thereafter, the line stubs 16, 19, 20, 23, 24, 28 and 30 are connected through their associated sealing sleeves to the assemblies 3 and 4 that are disposed fixedly in the washing machine. Straps 33 and 34 which are used to keep the line-routing body at a distance from the rear wall are bent in the direction of the rear wall and project beyond the outer contour of the line-routing body.

The invention is not restricted to the illustrated exemplary embodiment. In particular, the layout for routing lines can be adapted to the given conditions in a washing machine, which also applies to the position and placement of the connection stubs. In addition, it is possible to provide further lines in the line-routing body, for example a clean leakage water line according to German Published, Non-Prosecuted Patent Application DE 37 34 117 A1. If the device for supplying clean water and detergent from the detergent dispenser 4 is not to be connected in the top part of the tub, but rather is to open through a longer line into a region located at the bottom of the tub, then it is likewise recommended to integrate the water/detergent line in the line-routing body 5.

We claim:

1. A household washing machine, comprising:

a plastic line-routing body having supply line openings and a plurality of fluid lines having at least one inlet and at least one outlet, said plurality of fluid lines distributing a supply of clean water, discharging used detergent solution and conducting pressure-compensating air; and elastic sealing sleeves mechanically retaining and sealingly connecting said supply line openings to said at least one inlet and said at least one outlet.

2. The washing machine according to claim 1, including solenoid valves having outlets, at least one of said plurality of fluid lines being at least one clean water supply line having inlet sides connected directly to said outlets of said solenoid valves.

3. The washing machine according to claim 2, including a detergent dispenser having inlets, said at least one clean water supply line having outlet sides connected directly to said inlets of said detergent dispenser.

4. The washing machine according to claim 1, including a detergent dispenser having inlets, at least one of said plurality of fluid lines being at least one clean water supply line having outlet sides connected directly to said inlets of said detergent dispenser.

5. The washing machine according to claim 4, wherein said detergent dispenser has an overflow stub, and one of said plurality of fluid lines of said line-routing body is a line for conducting overflow water with an inlet side connected directly to said overflow stub of said detergent dispenser.

6. The washing machine according to claim 4, wherein said detergent dispenser has an air stub, and one of said plurality of fluid lines of said line-routing body is a line for conducting pressure-compensating air having an inlet side connected directly to said air stub of said detergent dispenser.

7. The washing machine according to claim 4, wherein one of said plurality of fluid lines of said line-routing body is a line for conducting overflow water from said detergent dispenser.

8. The washing machine according to claim 1, wherein one of said plurality of fluid lines of said line-routing body is a line for conducting overflow water from said at least one inlet.

9. The washing machine according to claim 1, wherein said plurality of fluid lines of said line-routing body includes a riser pipe and a down pipe for discharging used detergent solution, and said line-routing body has an overflow bend interconnecting said riser pipe and said down pipe.

10. The washing machine according to claim 9, including a backflow tank connected to said overflow bend and located in a path of said riser pipe for retaining a quantity of detergent solution required for backwashing.

11. The washing machine according to claim 1, wherein said line-routing body is a plastic blow-molded body.

12. The washing machine according to claim 11, including at least one strap integrally formed on said line-routing body for temporarily retaining said line-routing body before connections of said plurality of fluid lines are fitted.

* * * * *